US008718497B2

(12) United States Patent
Iwasaki

(10) Patent No.: US 8,718,497 B2
(45) Date of Patent: May 6, 2014

(54) CHARGING DEVICE AND IMAGE FORMING APPARATUS

(75) Inventor: Jin Iwasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 255 days.

(21) Appl. No.: 13/397,411

(22) Filed: Feb. 15, 2012

(65) Prior Publication Data

US 2013/0058667 A1 Mar. 7, 2013

(30) Foreign Application Priority Data

Sep. 1, 2011 (JP) ..... 2011-190826

(51) Int. Cl.
*G03G 15/00* (2006.01)
*G03G 15/02* (2006.01)

(52) U.S. Cl.
CPC ..... *G03G 15/00* (2013.01); *G03G 15/02* (2013.01); *G03G 15/0216* (2013.01)
USPC ..... 399/43; 399/50; 399/100; 399/158

(58) Field of Classification Search
USPC ..... 399/50, 100, 115, 168
See application file for complete search history.

(56) References Cited

U.S. PATENT DOCUMENTS 8,050,590 B2 * 11/2011 Parks ..... 399/100
2013/0121729 A1 * 5/2013 Tanaka et al. ..... 399/171

FOREIGN PATENT DOCUMENTS

JP 08-202116 A 8/1996
JP 2004-347953 A 12/2004
JP 2009-300805 A 12/2009
JP 2009-300806 A 12/2009

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

A charging device includes a charging member and a pulling device. The charging member charges a surface of an image carrier and includes a charging member body and axial-end members. The charging member body is arranged so as to face the image carrier and extends along an axial direction of a rotation shaft of the image carrier. The axial-end members are supported at both ends of the charging member body in the axial direction and do not extend through the inside of the charging member body in the axial direction. The pulling device pulls the charging member in the axial direction.

4 Claims, 9 Drawing Sheets

CHARGING DEVICE AND IMAGE FORMING APPARATUS

CROSS-REFERENCE TO RELATED APPLICATIONS

This application is based on and claims priority under 35 USC 119 from Japanese Patent Application No. 2011-190826 filed Sep. 1, 2011.

BACKGROUND

The present invention relates to a charging device and an image forming apparatus.

SUMMARY

According to an aspect of the invention, there is provided a charging device including a charging member and a pulling device. The charging member charges a surface of an image carrier and includes a charging member body and axial-end members. The charging member body is arranged so as to face the image carrier and extends along an axial direction of a rotation shaft of the image carrier. The axial-end members are supported at both ends of the charging member body in the axial direction and do not extend through the inside of the charging member body in the axial direction. The pulling device pulls the charging member in the axial direction.

BRIEF DESCRIPTION OF THE DRAWINGS

Exemplary embodiments of the present invention will be described in detail based on the following figures, wherein:

FIG. 7A illustrates a charging roller of the related art that has a rotation rod that extends therethrough, FIG. 7B illustrates the charging roller of FIG. 7A viewed in the direction shown by arrow VIIB, FIG. 7C illustrates a charging roller of the related art that does not have a rotation rod that extends therethrough, and FIG. 7D illustrates the charging roller of FIG. 7C viewed in the direction shown by arrow VIID;

FIG. 8A shows the initial state in which the photoconductor is not worn in the case where a charging roller of the first exemplary embodiment or a charging roller of the related art that includes a shaft is used, FIG. 8B shows the state in which the photoconductor has become worn over time in the case where the charging roller of the related art that includes the shaft is used, FIG. 8C shows the initial state in the case where a shaftless charging roller of the related art is used, and FIG. 8D illustrates the state in which the photoconductor has become worn over time in the case where the charging roller of the first exemplary embodiment or the shaftless charging roller of the related art is used.

DETAILED DESCRIPTION

Exemplary embodiments of the present invention will now be described below with reference to the drawings. The present invention is not limited to the following exemplary embodiments.

To facilitate understanding of the following descriptions, the front-back direction, the left-right direction, and the up-down direction are defined as the X-axis direction, the Y-axis direction, and the Z-axis direction, respectively, in each figure. In addition, directions shown by arrows X, −X, Y, −Y, Z, and −Z are defined as forward, backward, rightward, leftward, upward, and downward, respectively, and sides in those directions are defined as the front side, the back side, the right side, the left side, the top side, and the bottom side, respectively.

In the figures, circles having dots at the center show the direction from back to front with respect to the sides illustrated in the figures, and circles having the "x" marks therein show the direction from front to back with respect to the sides illustrated in the figures.

In each figure, components other than those necessary for the explanations are omitted to facilitate understanding.

First Exemplary Embodiment

Figure 1:
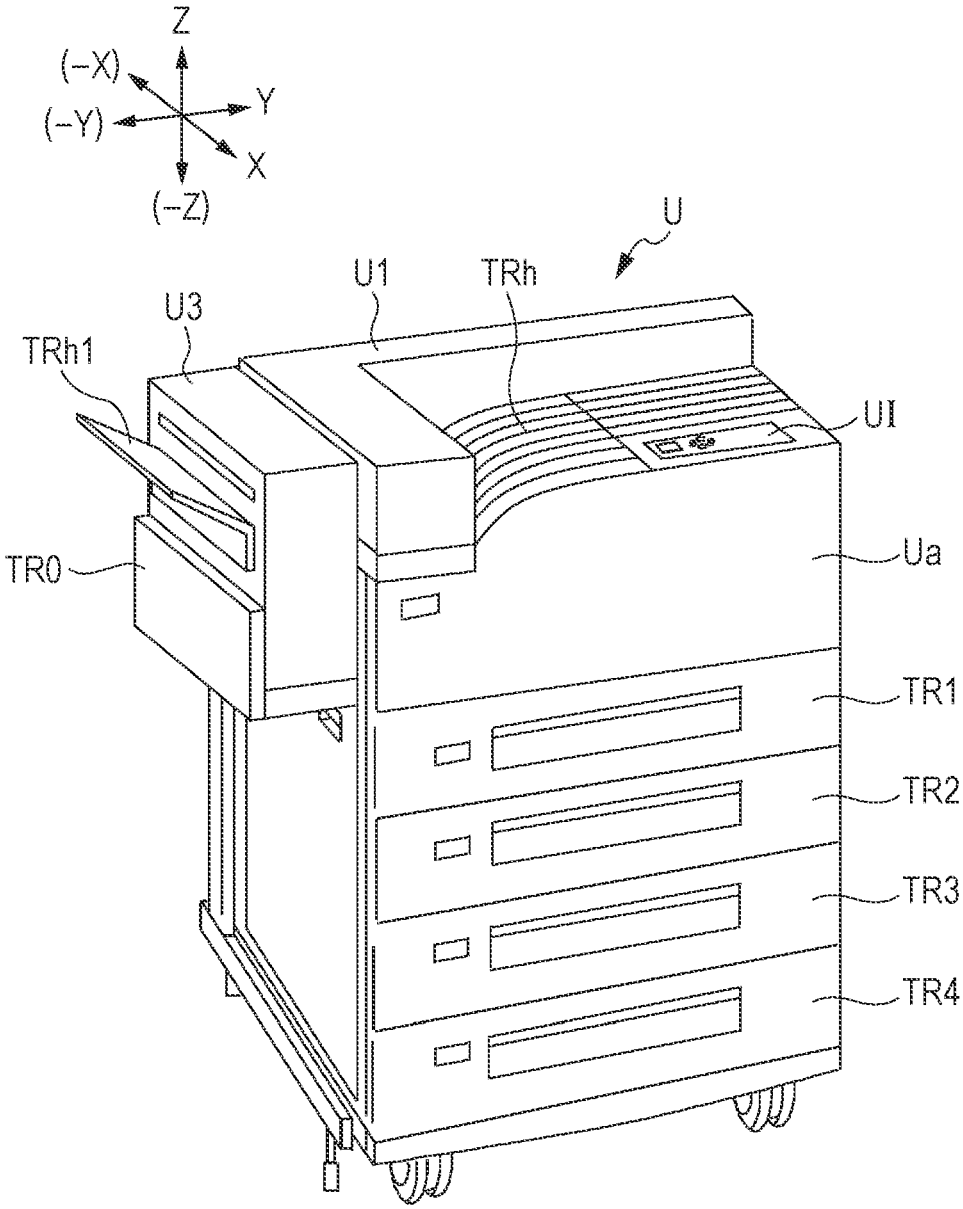
FIG. 1 is a perspective view of an image forming apparatus according to a first exemplary embodiment.

FIG. 1 is a perspective view of an image forming apparatus according to a first exemplary embodiment.

Referring to FIG. 1, a printer U, which is an example of an image forming apparatus according to the first exemplary embodiment, includes a printer body U1, which is an example of an apparatus body. A first paper output tray (so-called face-down tray) TRh, which is an example of a first medium output portion, is provided at the top of the printer body U1. An operation unit UI, which is used by a user to perform an input operation, is provided in the front area of the top surface of the first paper output tray TRh at the front end thereof in a medium output direction. The operation unit UI includes, for example, a display. A front panel Ua, which is an example of a front opening-closing portion, is arranged on the front face of the upper section of the printer U. The front panel Ua is rotatably supported on the printer body U1 by a rotation shaft that extends in the left-right direction at the lower end of the front panel Ua. Thus, the front panel Ua may be opened to allow a toner cartridge, which is an example of a developer container, a process unit, which is an example of a visible-image forming unit, etc., to be replaced.

Figure 2:
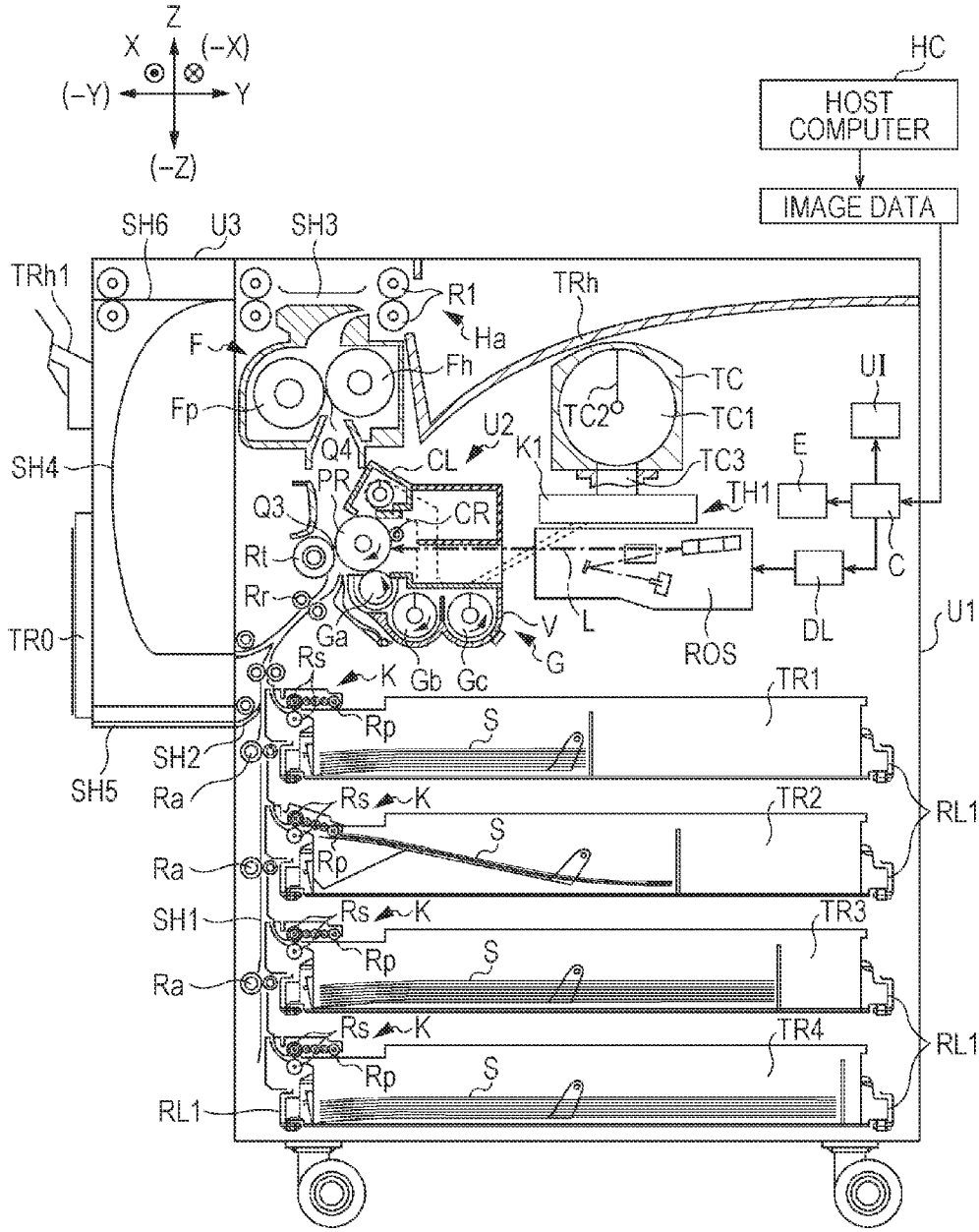
FIG. 2 illustrates the overall structure of the image forming apparatus according to the first exemplary embodiment.

FIG. 2 illustrates the overall structure of the image forming apparatus according to the first exemplary embodiment.

Referring to FIG. 2, the printer U is electrically connected to a host computer HC, which is an example of an image-information transmitting apparatus. Image information and electrical signals such as a control signal transmitted from the host computer HC are input to a controller C, which is an example of a control section of the printer U. The controller C temporarily stores the image information input thereto, converts the image information into information used to form a latent image at a preset timing, and outputs the converted information to a laser drive circuit DL, which is an example of a latent-image forming circuit.

The laser drive circuit DL outputs a driving signal corresponding to the information input thereto to a latent-image forming device ROS. The operations of the operation unit UI, the laser drive circuit DL, and a power circuit E that applies voltages to a developing roller Ga and a transfer roller Rt, which will be described below, are controlled by the controller C.

Figure 3:
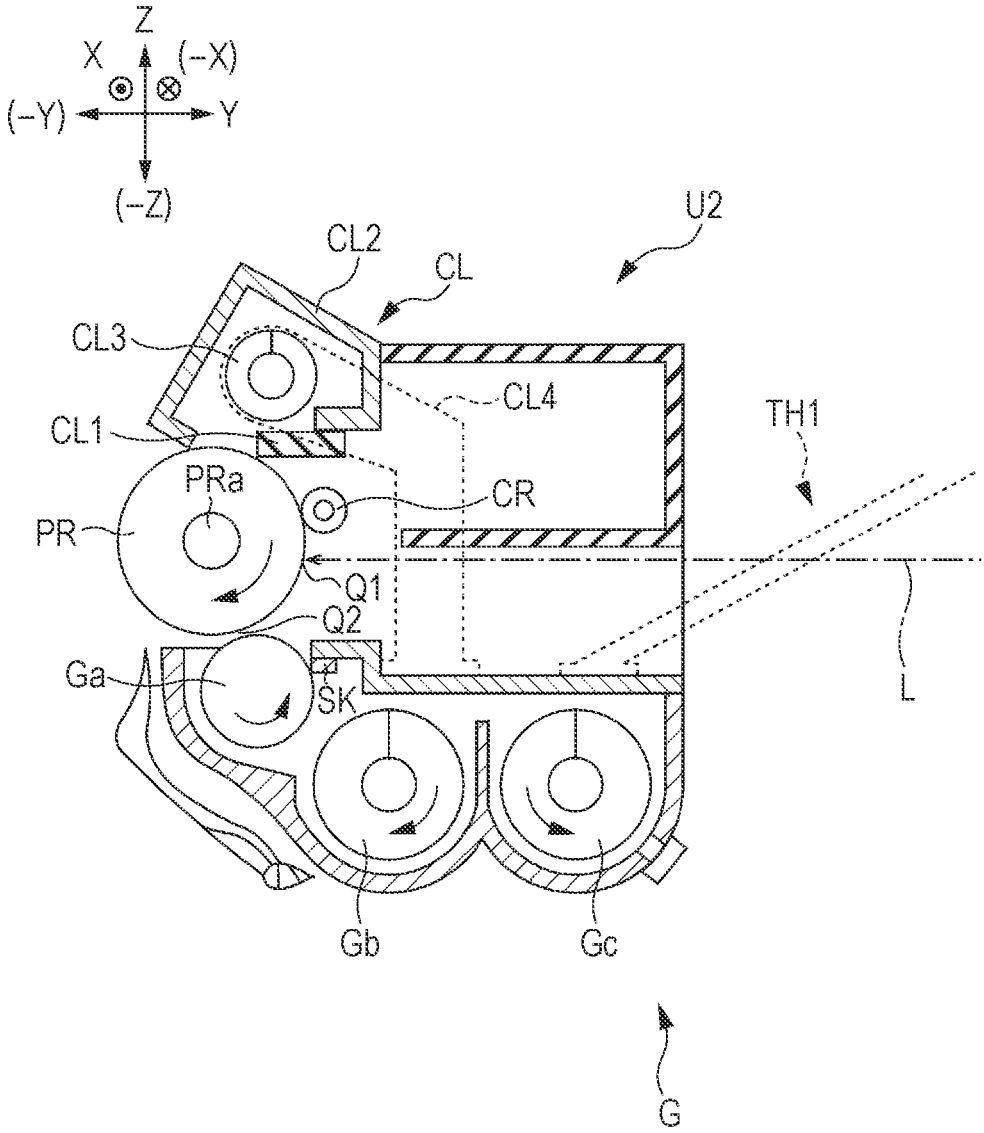
FIG. 3 is an enlarged view of a toner-image forming device illustrated in FIG. 2.

FIG. 3 is an enlarged view of a toner-image forming device U2 illustrated in FIG. 2.

Referring to FIGS. 2 and 3, the toner-image forming device U2, which is an example of a visible-image forming device that forms a black toner image, is provided on the left side of the latent-image forming device ROS. A laser beam L, which is an example of latent-image forming light, is emitted from the latent-image forming device ROS and is incident on a photoconductor PR that rotates.

Referring to FIGS. 2 and 3, the toner-image forming device U2 according to the first exemplary embodiment includes the photoconductor PR, which is an example of an image carrier, a charging roller CR, which is an example of a charging member, a developing device G, and a photoconductor cleaner CL, which is an example of an image-carrier cleaner for. The photoconductor PR rotates around a rotation shaft PRa in a direction shown by the arrow. The toner-image forming device U2 is in the form of a unit, and is detachably attached to the image-forming-apparatus body U1 as a process unit. The process unit U2 is attached to and detached from the image-forming-apparatus body U1 while the front panel Ua is opened, the front panel Ua being provided at the front side of the image-forming-apparatus body U1 in a manner such that the front panel Ua may be opened and closed.

Referring to FIGS. 2 and 3, the surface of the photoconductor PR is charged by the charging roller CR, to which a charging voltage is applied, and is then scanned with the laser beam L emitted from the latent-image forming device ROS at a latent-image drawing position Q1. Thus, an electrostatic latent image is formed. The surface of the photoconductor PR on which the electrostatic latent image is formed rotates and successively passes through a development area Q2 and a transfer area Q3.

The developing device G includes a developing-device container V that contains toner, which is an example of developer. The developing roller Ga, which is an example of a developer carrier, is rotatably supported in the developing-device container V. The developing roller Ga faces the photoconductor PR in the development area Q2, and receives a developing voltage. Toner-stirring members Gb and Gc that transport the toner to the developing roller Ga while stirring the toner are rotatably supported in the developing-device container V. Thus, as the developing roller Ga rotates, the toner on the surface of the developing roller Ga is transported to the development area Q2, and the electrostatic latent image on the photoconductor PR that passes through the development area Q2 is developed into a toner image, which is an example of a visible image.

The developing-device container V is connected at the front end thereof to one end of a supply path of a cartridge-toner supplying device TH1, which is an example of a developer supplying device. The cartridge-toner supplying device TH1 is fixed to the printer U. The other end of the supply path of the cartridge-toner supplying device TH1 is connected to an ejection port TC3 of a toner cartridge TC, which is an example of a developer container.

Referring to FIG. 2, the toner cartridge TC includes a cartridge body TC1, which is an example of a container body that contains toner. A toner-transporting member TC2, which is an example of a transporting member in the container, is rotatably supported in the cartridge body TC1. As the toner is consumed in the developing device G, the toner-transporting member TC2 rotates so as to transport the toner in the cartridge body TC1 to the ejection port TC3. The toner ejected from the ejection port TC3 is transported to the developing-device container V in the developing device G by a supply-path transporting member (not shown) provided in the supply path of the cartridge-toner supplying device TH1.

The toner cartridge TC is attachable to and detachable from the printer U by being inserted into and extracted from the printer U in the front-back direction. The toner cartridge TC is attached to and detached from the printer body U1 while the front panel Ua is opened, the front panel Ua being provided at the front side of the printer body U1 in a manner such that the front panel Ua may be opened and closed.

The photoconductor PR, the charging roller CR, the latent-image forming device ROS, the developing device G, etc. form the toner-image forming device U2 that forms a toner image on the photoconductor PR.

Referring to FIGS. 1 and 2, plural sheet trays TR1 to TR4, which are examples of medium containers, are provided in the lower section of the printer U. The sheet trays TR1 to TR4 contain recording sheets S, which are examples of media, to be transported to the transfer area Q3.

Referring to FIG. 2, rails RL1, which are examples of container guide members, are arranged in the lower section of the printer U. The rails RL1 support the sheet trays TR1 to TR4 at the left and right ends thereof in a manner such that the sheet trays TR1 to TR4 may be inserted into and withdrawn from the printer U. Thus, the sheet trays TR1 to TR4 are each supported by a pair of left and right rails RL1 so as to be movable in the front-back direction. Thus, the sheet trays TR1 to TR4 may be inserted into and withdrawn from the printer U at the front side of the printer U.

Referring to FIG. 2, a sheet-feeding device K is provided above each of the sheet trays TR1 to TR4 at a feed side thereof. Each sheet-feeding device K includes a pickup roller Rp, which is an example of a medium pickup member, and a separating roller group Rs, which is an example of a separating member. The separating roller group Rs includes a feed roller, which is an example of a medium transport member, and a retard roller, which is an example of a medium separating member.

The recording sheets S are picked up by the pickup roller Rp of one of the sheet-feeding devices K, and are fed to a printer-body transport path SH1 after the sheets S are separated from each other by the separating roller group Rs. Each sheet S fed to the printer-body transport path SH1 is transported by plural sheet transporting rollers Ra arranged in the printer-body transport path SH1. The transporting rollers Ra are examples of transporting members. The sheet S transported by the sheet transporting rollers Ra is further transported to the transfer area Q3 by a registration roller Rr, which is an example of a timing adjusting member, in synchronization with the time when the toner image on the surface of the photoconductor PR reaches the transfer area Q3.

A manual feed tray TR0, which is an example of a manual feed portion, is attached to the printer U at the left side thereof. A sheet S fed from the manual feed tray TR0 is fed along a manual-feed additional transport path SH5 and a manual-feed transport path SH2, and is transported by the sheet transporting rollers Ra in the printer-body transport path SH1. Then, the sheet S is further transported to the transfer area Q3 by the registration roller Rr.

Referring to FIG. 2, the transfer roller Rt, which is an example of a transfer device, is provided in the transfer area Q3. A transfer voltage is applied to the transfer roller Rt. In the transfer area Q3, the transfer roller Rt is in pressure contact with the photoconductor PR at a preset pressure. The transfer roller Rt transfers the toner image on the photoconductor PR onto the sheet S that passes through the transfer area Q3.

Referring to FIG. 3, after the toner image on the surface of the photoconductor PR is transferred onto the sheet S in the transfer area Q3, residual toner, which is an example of residual developer, on the surface of the photoconductor PR is removed and collected by a cleaning blade CL1, which is an example of a cleaning member, included in the photoconductor cleaner CL. Thus, the photoconductor PR is cleaned. The residual toner removed by the cleaning blade CL1 is received by a cleaner container CL2, which is an example of a cleaner container member. The toner in the cleaner container CL2 is transported forward by a collecting auger CL3, which is an example of a collecting transport member, and is returned to the developing-device container V through a collecting path CL4 provided at the front end of the cleaner container CL2. Thus, the toner is reused.

After the residual toner is removed from the surface of the photoconductor PR by the photoconductor cleaner CL, the photoconductor PR is charged by the charging roller CR again.

The sheet S onto which the toner image has been transferred in the transfer area Q3 is transported to a fixing area Q4 in a fixing device F in the state in which the toner image is not fixed. The fixing device F includes a heating roller Fh, which is an example of a thermal-fixing member, and a pressure roller Fp, which is an example of a pressure-fixing member. The toner image is thermally fixed in the fixing area Q4 in which the heating roller Fh and the pressure roller Fp are in contact with each other.

The toner-image forming device U2, the transfer roller Rt, and the fixing device F form an image recording unit U2+Rt+F that records an image on the sheet S.

The sheet S to which the toner image is fixed is guided to paper output rollers R1, which are examples of output members, by a sheet guide, which is an example of a medium guide member. The paper output rollers R1 eject the sheet S to the first paper output tray TRh through a sheet output port Ha, which is an example of a medium output port.

A printer-body reversing path SH3 that is connected to the sheet output port Ha is provided above the fixing device F in the printer U. A sheet-reversing device U3, which is an example of a medium-reversing device, is provided above the manual feed tray TR0 as an additional device. An optional sheet reversing path SH4, which is an example of an additional reversing path, is provided in the sheet-reversing device U3. The optional sheet reversing path SH4 is connected to the printer-body reversing path SH3. In duplex printing, the sheet S to which the toner image is fixed in the fixing area Q4 is transported to the registration roller Rr through the printer-body reversing path SH3 and the optional sheet reversing path SH4, and is returned to the transfer area Q3.

The printer-body reversing path SH3 and the optional sheet reversing path SH4 form a reversing path SH3+SH4.

The sheet-reversing device U3 also includes an optional paper output tray (so-called face-up tray) TRh1, which is an example of an additional medium output portion. The sheet S is output to the optional paper output tray TRh1 in a manner such that the side thereof on which the image is recorded faces upward. An optional sheet output path SH6, which is an example of an additional output path, is provided between the optional paper output tray TRh1 and the printer-body reversing path SH3. When the sheet S is to be output to the optional paper output tray TRh1 according to the setting made by the user, the sheet S is output to the optional paper output tray TRh1 through the printer-body reversing path SH3 and the optional sheet output path SH6.

Description of Charging Device

Figure 4:
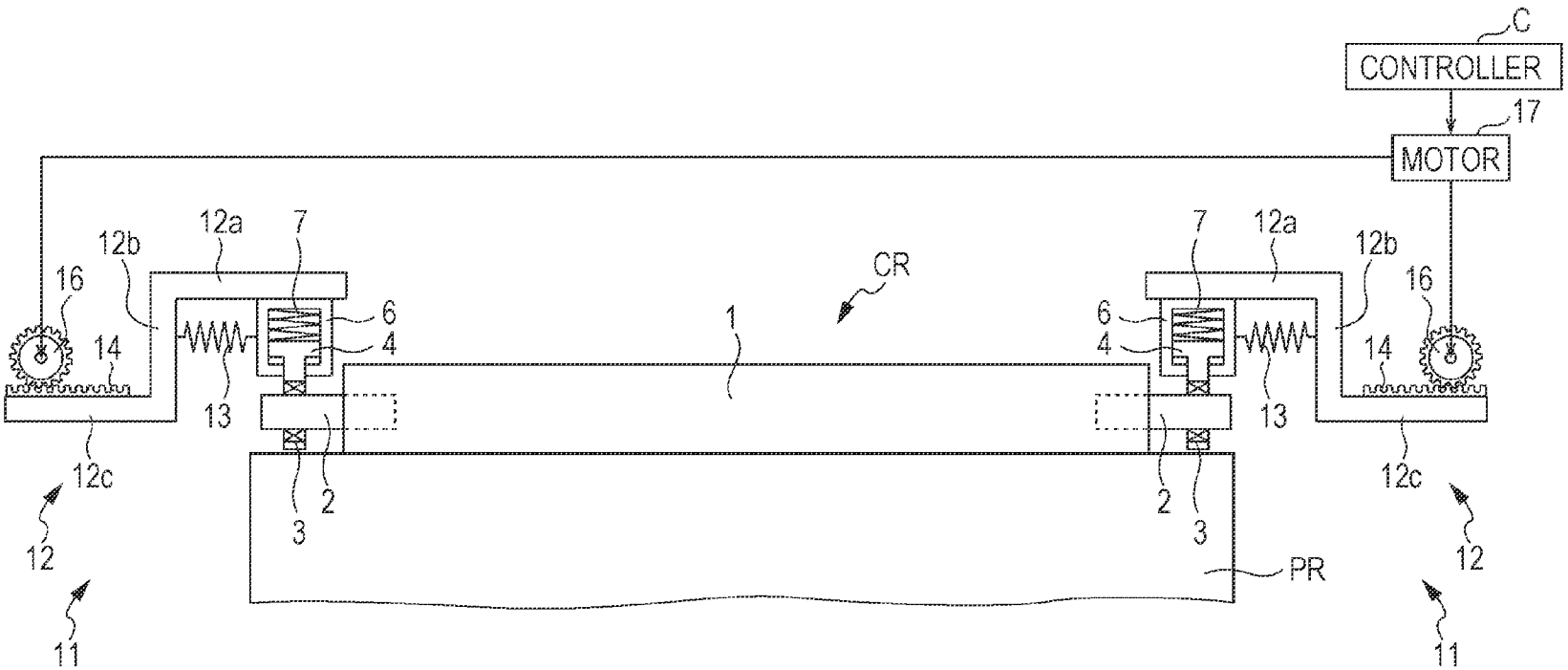
FIG. 4 is an enlarged view of a charging device according to the first exemplary embodiment.

FIG. 4 is an enlarged view of a charging device according to the first exemplary embodiment.

Referring to FIG. 4, the charging roller CR according to the first exemplary embodiment includes a roller body 1, which is an example of a charging member body, and columnar rod portions 2, which are examples of axial-end members. The roller body 1 extends in an axial direction of the photoconductor PR. The rod portions 2 are supported at both ends of the roller body 1 in the axial direction. According to the first exemplary embodiment, the rod portions 2 do not extend through the inside of the roller body 1. In other words, a pair of rod portions 2 are provided at both ends of the roller body 1, and the charging roller CR has a shaftless structure.

The rod portions 2 are rotatably supported by bearings 3, which are examples of bearing members, at the outer ends of the rod portions 2. The bearings 3 are supported by sliders 4, which are examples of bearing retainers. The sliders 4 are supported by slider guides 6, which are examples of bearing guides, in a manner such that the sliders 4 are movable in directions toward and away from the photoconductor PR. Coil springs 7, which are examples of urging members, are provided between the slider guides 6 and the sliders 4. The coil springs 7 urge the sliders 4 toward the photoconductor PR, thereby urging the charging roller CR toward the photoconductor PR.

The slider guides 6 are supported by a pair of front and back pulling devices 11 that are supported in a manner such that the pulling devices 11 are movable in the front-back direction of the printer body U1, that is, along the axial direction of the charging roller CR. In the first exemplary embodiment, the pulling devices 11 include pulling frames 12, which are examples of frame members. The pulling frames 12 include guide retaining portions 12*a*, which are examples of guide retainers. The guide retaining portions 12*a* retain the respective slider guides 6 in a manner such that the slider guides 6 are movable in the front-back direction. Spring retaining portions 12*b*, which are examples of pulling-member retainers, are arranged so as to extend toward the photoconductor PR at the outer ends of the guide retaining portions 12*a* in the axial direction. Tension springs 13, which are examples of pulling members, are arranged between the spring retaining portions 12*b* and the slider guides 6. The tension springs 13 pull the slider guides 6 outward in the axial direction.

Driven portions 12*c* that extend outward in the axial direction are provided at the ends of the spring retaining portions 12*b* that are near the photoconductor PR. Rack tooth portions 14, which are examples of flat gears, are formed on the driven portions 12*c* so as to extend in the front-back direction. Pinion gears 16, which are examples of gears, mesh with the rack tooth portions 14. The pinion gears 16 receive a driving force from a pulling motor 17, which is an example of a drive source. The pulling motor 17 is rotatable in forward and reverse directions in response to a control signal from the controller C.

In the first exemplary embodiment, at the time when the printer U is shipped or immediately after the charging device is replaced, that is, in the initial state, the pulling frames 12 are arranged to be farthest from each other in the axial direction of the charging roller CR. In addition, the tension applied to the charging roller CR in the axial direction thereof by the tension springs 13 through the slider guides 6 is at a maximum.

The components denoted by reference numerals 12 to 17 form the pulling devices 11 according to the first exemplary embodiment. The charging roller CR, the pulling devices 11, a voltage applying circuit (not shown), etc., and a unit for controlling these components form the charging device CrR+11 according to the first exemplary embodiment.

Description of Control Section of First Exemplary Embodiment

Figure 5:
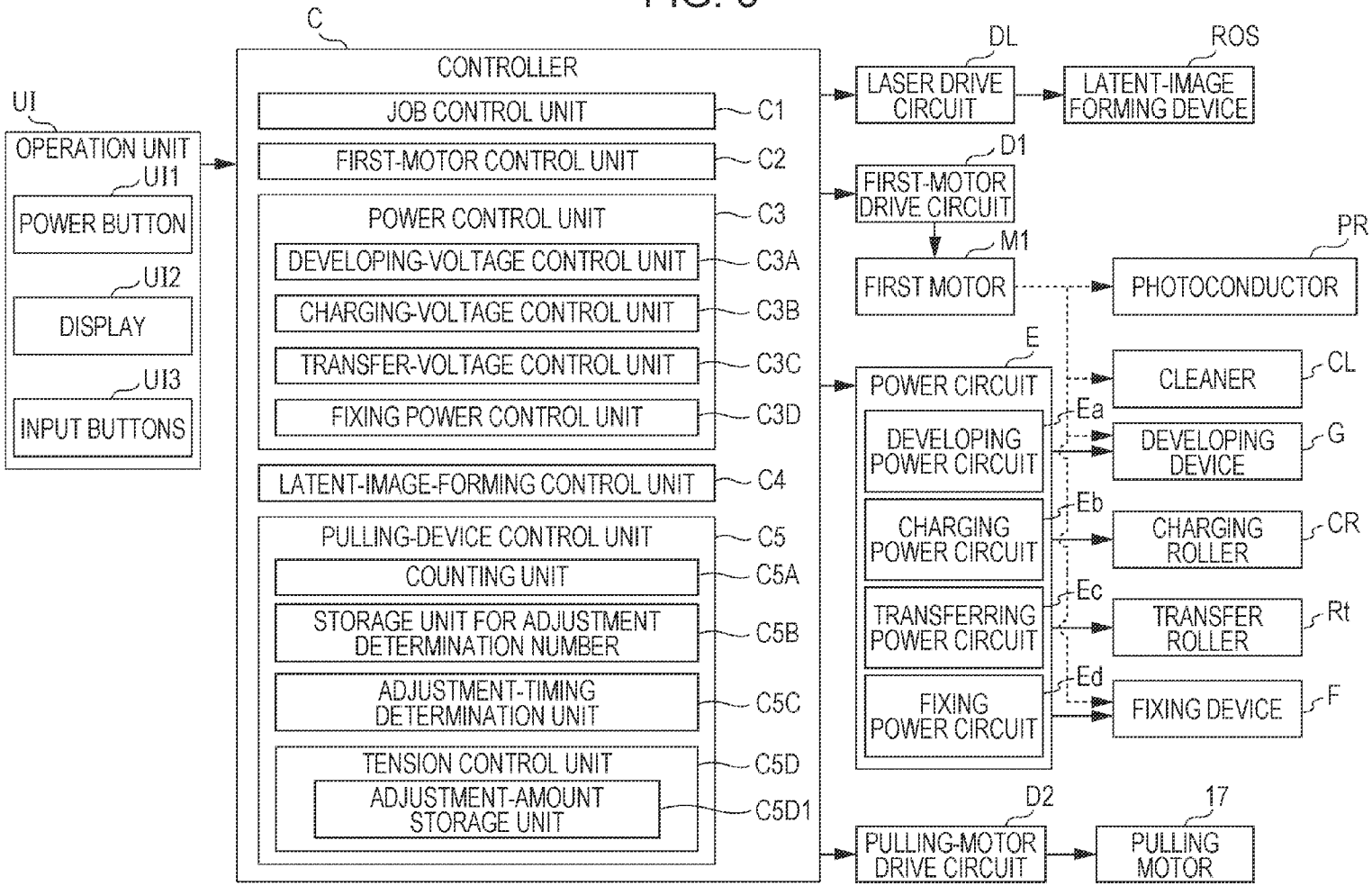
FIG. 5 is a functional block diagram illustrating the functions of a control section in the image forming apparatus according to the first exemplary embodiment of the present invention.

FIG. 5 is a block diagram illustrating functions of a control section in the image forming apparatus according to the first exemplary embodiment of the present invention.

Referring to FIG. 5, the controller C included in the printer U according to the first exemplary embodiment is formed of a microcomputer, which is a small image processing device. The controller C includes an I/O device that outputs and receives signals to and from an external device and that adjusts an input/output signal level; a ROM that stores programs for executing certain processes, data, etc.; a RAM that temporarily stores certain data; a HDD; a CPU that performs operations in accordance with programs stored in the ROM or the HDD; and a clock oscillator. The controller C performs various functions by executing the programs stored in the ROM.

Signal Output Elements Connected to Controller C.

Output signals from signal output elements, such as the operation unit UI, are connected to the controller C.

The operation unit UI includes a power-source button UI1 operated to turn on or off a power source of the printer U, a display UI2, and various input buttons UI3 including arrow keys, which are examples of direction input buttons.

Elements to be Controlled Connected to Controller C

The controller C outputs control signals to the following elements DL, D1, D2, and E that are to be controlled:

DL: Laser Drive Circuit

A laser drive circuit DL controls the latent-image forming device ROS to form the latent image on the surface of the photoconductor PR.

D1: First-Motor Drive Circuit

A first-motor drive circuit D1, which is an example of a first-drive-source drive circuit, drives a first motor M1, which is an example of a first drive source, to rotate the photoconductor PR.

D2: Pulling-Motor Drive Circuit

A pulling-motor drive circuit D2, which is an example of a tension-adjusting drive circuit, drives the pulling motor 17 to move the pulling frames 12.

E: Power Circuit

The power circuit E includes a developing power circuit Ea, a charging power circuit Eb, a transferring power circuit Ec, and a fixing power circuit Ed.

Ea: Developing Power Circuit

The developing power circuit Ea applies a developing voltage to the developing roller Ga in the developing device G.

Eb: Charging Power Circuit

The charging power circuit Eb applies a charging voltage for charging the surface of the photoconductor PR to the charging roller CR.

Ec: Transferring Power Circuit

The transferring power circuit Ec applies a transfer voltage to the transfer roller Rt.

Ed: Fixing Power Circuit

The fixing power circuit Ed serves as a power source for a heater in the heating roller Fh included in the fixing device F.

Functions of Controller C

The controller C executes processes corresponding to signals input from the above-described signal output elements and outputs control signals to the above-described elements to be controlled. Specifically, the controller C includes the following functional units:

C1: Job Control Unit

A job control unit C1, which is an example of an image forming control unit, executes a job, which is an example of an image forming operation, by controlling the operations of the charging roller CR, the transfer roller Rt, the fixing device F, etc., in accordance with received image information.

C2: First-Motor Control Unit

A first-motor control unit C2, which is an example of a first-drive-source control unit, controls the operations of, for example, the developing device G, the heating roller Fh included the fixing device F, the paper output rollers R1, etc., by controlling the operation of the first motor M1 through the first-motor drive circuit D1.

C3: Power-Source Control Unit

A power-source control unit C3 includes a developing-voltage control unit C3A, a charging-voltage control unit C3B, a transfer-voltage control unit C3C, a fixing-power-source control unit C3D, and a temperature-increasing-voltage control unit C3E. The power-source control unit C3 controls the supply of voltages and electric power to the components by controlling the operation of the power circuit E.

C3A: Developing-Voltage Control Unit

The developing-voltage control unit C3A controls the developing voltage applied to the developing roller Ga in the developing device G by controlling the developing power circuit Ea.

C3B: Charging-Voltage Control Unit

The charging-voltage control unit C3B controls the charging voltage applied to the charging roller CR by controlling the charging power circuit Eb. In the first exemplary embodiment, when the image forming operation is performed, the charging-voltage control unit C3B executes a constant current control to maintain the current at 1.4 [mA], so that the charging voltage is applied to the charging roller CR.

C3C: Transfer-Voltage Control Unit

The transfer-voltage control unit C3C controls the transfer voltage applied to the transfer roller Rt by controlling the transferring power circuit Ec.

C3D: Fixing-Power-Source Control Unit

The fixing-power-source control unit C3D controls the fixing power circuit Ed so as to control the on/off state of the fixing device F and the fixing temperature.

C4: Latent-Image-Forming Control Unit

A latent-image-forming control unit C4 controls the laser drive circuit DL so as to form a latent image on the surface of the photoconductor PR by operating the latent-image forming device ROS.

C5: Pulling-Device Control Unit

A pulling-device control unit C5 includes a counting unit C5A, a storage unit C5B for storing an adjustment determination number of sheets, an adjustment-timing determination unit C5C, and a tension control unit C5D. The pulling-device control unit C5 controls the pulling devices 11 to control the tension applied to the charging roller CR in the axial direction.

C5A: Counting Unit

The counting unit C5A counts the accumulated number of revolutions of the charging roller CR. According to the first exemplary embodiment, the counting unit C5A indirectly counts the accumulated number of revolutions of the charging roller CR by counting the accumulated number N1 of sheets subjected to printing performed by the printer U. Although the accumulated number N1 of sheets subjected to printing is used in the first exemplary embodiment, the accumulated number of revolutions may instead be directly counted. Alternatively, other numbers, that is, parameters, having a strong correlation with the accumulated number of revolutions may be used instead. For example, parameters such as the accumulated time during which the charging roller CR is rotated, the accumulated time during which the printer U is driven, the accumulated number of revolutions of the photoconductor PR, or the accumulated time during which the photoconductor PR is rotated may be used.

C5B: Storage Unit for Adjustment Determination Number of Sheets

The storage unit C5B for storing the adjustment determination number of sheets is an example of a storage unit for an adjustment-timing determination value, and stores an adjustment determination number Na of sheets that is used to determine the time at which the tension is to be adjusted. According to the first exemplary embodiment, the adjustment determination number Na of sheets is set to Na=500 as an example. However, the adjustment determination number Na of sheets may instead be set to other numbers in accordance with, for example, the design or specification.

C5C: Adjustment-Timing Determination Unit

The adjustment-timing determination unit C5C determines whether or not the time to adjust the tension has been reached on the basis of the accumulated number N1 of sheets subjected to printing counted by the counting unit C5A. According to the first exemplary embodiment, the adjustment-timing determination unit C5C determines whether or not the time to adjust the tension has been reached by determining whether or not the accumulated number N1 of sheets subjected to printing is greater than or equal to the adjustment determination number Na of sheets.

C5D: Tension Control Unit

The tension control unit C5D includes an adjustment-amount storage unit C5D1 that stores an amount of rotation of the pulling motor 17 as an example of an adjustment amount, and controls the tension by controlling the pulling motor 17 through the pulling-motor drive circuit D2. The tension control unit C5D according to the first exemplary embodiment reduces the tension applied by the tension springs 13 over time on the basis of the result of counting performed by the counting unit C5A. According to the first exemplary embodiment, when the adjustment-timing determination unit C5C determines on the basis of the result of counting that the time to adjust the tension has been reached, the tension control unit C5D rotates the pulling motor 17 forward by the amount of rotation stored in the adjustment-amount storage unit C5D1. Accordingly, the pair of front and back pulling frames 12 are moved toward each other along the axial direction of the charging roller CR, so that the spring retaining portions 12*b* are moved toward each other to reduce the tension applied by the pulling motor 17.

C5D1: Adjustment-Amount Storage Unit

The adjustment-amount storage unit C5D1 stores the amount of rotation of the pulling motor 17. According to the first exemplary embodiment, the amount of rotation of the pulling motor 17 is preset on the basis of, for example, experiment results. The amount of rotation of the pulling motor 17 is set in accordance with a reduction in the thickness of the layer on the surface of the photoconductor PR caused when the adjustment determination number Na of sheets has been reached and an amount of bending of the charging roller CR with which a potential difference between central and end portions of the charging roller CR in the axial direction is reduced when the central portion of the charging roller CR in the axial direction is bent toward the downstream side.

Description of Flowchart of First Exemplary Embodiment

The process performed by the image forming apparatus U according to the first exemplary embodiment will now be described with reference to a flowchart.

Description of Flowchart of Tension Control Process

Figure 6:
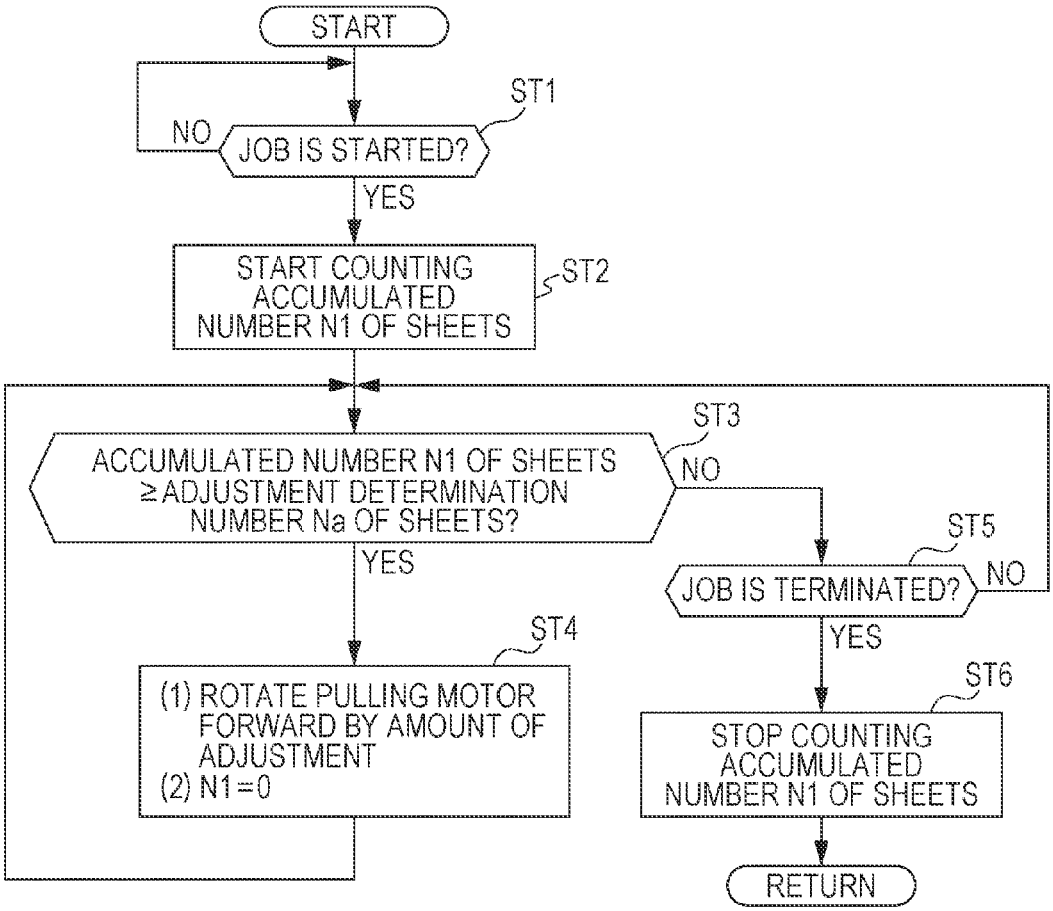
FIG. 6 is a flowchart of a tension control process according to the first exemplary embodiment.

FIG. 6 is a flowchart of a tension control process according to the first exemplary embodiment.

Each of the steps (ST) in the flowchart of FIG. 6 is performed in accordance with the programs stored in the hard disk or the like in the controller C of the printer U. The tension control process is executed concurrently with other processes performed by the printer U.

The flowchart illustrated in FIG. 6 is started when the power of the printer U is turned on.

In ST1 of FIG. 6, it is determined whether or not a job, which is an example of an image forming operation, has been started. If the result of the determination is yes (Y), the process proceeds to ST2. If the result of the determination is no (N), ST1 is repeated.

In ST2, counting of the accumulated number N1 of sheets subjected to printing is started. Then, the process proceeds to ST3.

In ST3, it is determined whether or not the accumulated number N1 of sheets subjected to printing is greater than or equal to the adjustment determination number Na of sheets. If the result of the determination is yes (Y), the process proceeds to ST4. If the result of the determination is no (N), the process proceeds to ST5.

In ST4, the following processes (1) and (2) are performed, and then the process returns to ST3.

(1) The pulling motor 17 is rotated forward by the adjustment amount.

(2) The accumulated number N1 of sheets subjected to printing is initialized to 0. In other words, N1 is set to N1=0.

In ST5, it is determined whether or not the job has been finished. If the result of the determination is no (N), the process returns to ST3. If the result of the determination is yes (Y), the process proceeds to ST6.

In ST6, counting of the accumulated number N1 of sheets is terminated. Then, the process returns to ST1.

Operation of First Exemplary Embodiment

In the printer U according to the first exemplary embodiment having the above-described structure, the shaftless charging roller CR is supported in a manner such that the charging roller CR is pulled in the axial direction by the tension applied by the tension springs 13 that pull the slider guides 6. Accordingly, compared to the charging roller that is not provided with the tension springs 13, the charging roller CR according to the first exemplary embodiment is not easily curved or bent with respect to the axial direction and is more easily retained in the state in which the charging roller CR extends along the axial direction. Thus, the charging roller CR that faces and comes into contact with the photoconductor PR and that is rotated by the rotation of the photoconductor PR is not easily bent along the rotation direction of the photoconductor PR.

Figure 7A:
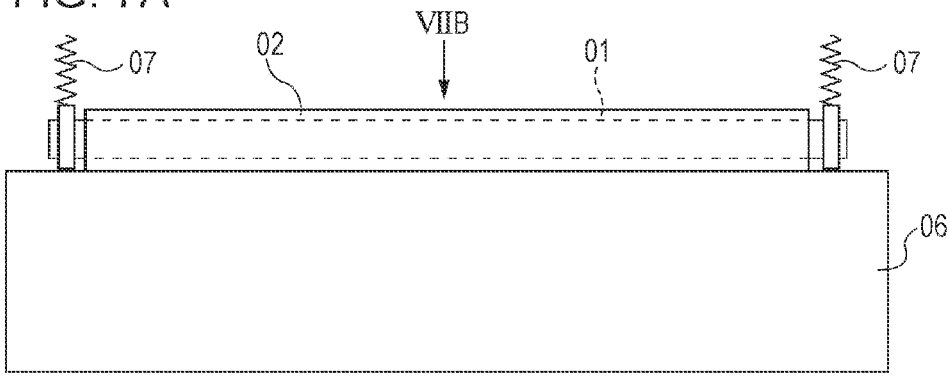
FIGS. 7A to 7D illustrate charging rollers according to the related art, where
Figure 7B:
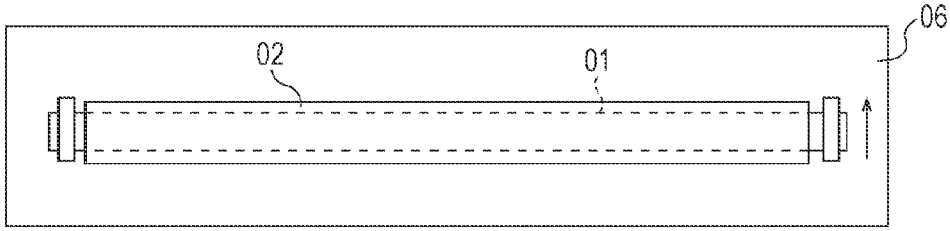
Figure 7C:
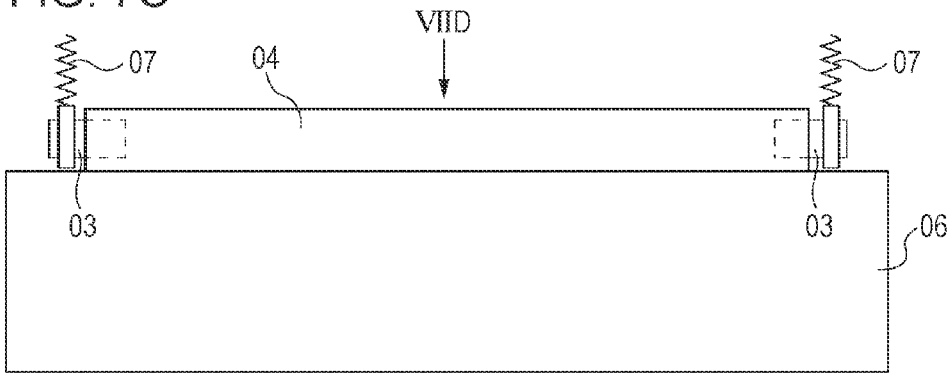
Figure 7D:
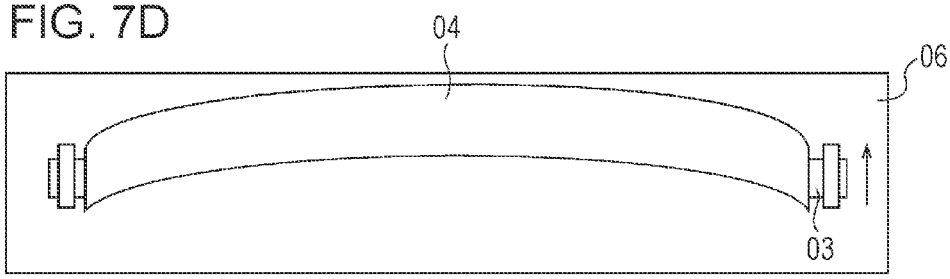

FIGS. 7A to 7D illustrate charging rollers according to the related art. FIG. 7A illustrates a charging roller of the related art that has a rotation rod that extends therethrough. FIG. 7B illustrates the charging roller of FIG. 7A viewed in the direction shown by arrow VIIB. FIG. 7C illustrates a charging roller of the related art that does not have a rotation rod that extends therethrough. FIG. 7D illustrates the charging roller of FIG. 7C viewed in the direction shown by arrow VIID.

Figure 8A:
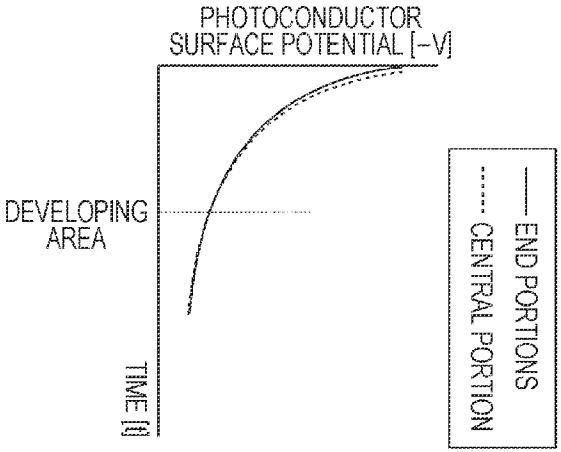
FIGS. 8A to 8D are graphs in which the horizontal axis shows the position on the surface of a photoconductor and the vertical axis shows the potential on the surface of the photoconductor, where
Figure 8C:
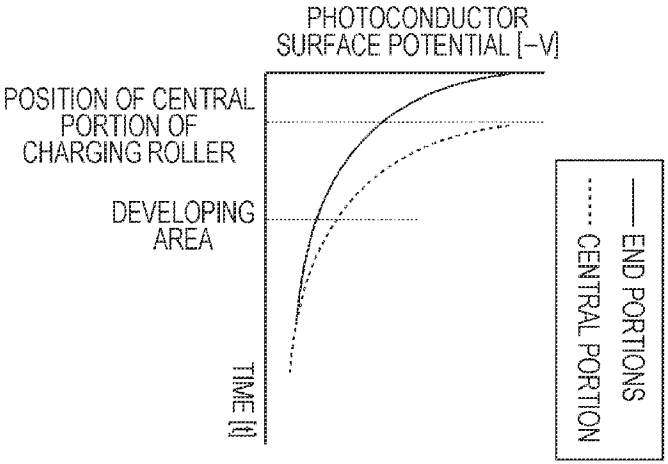
Figure 8B:
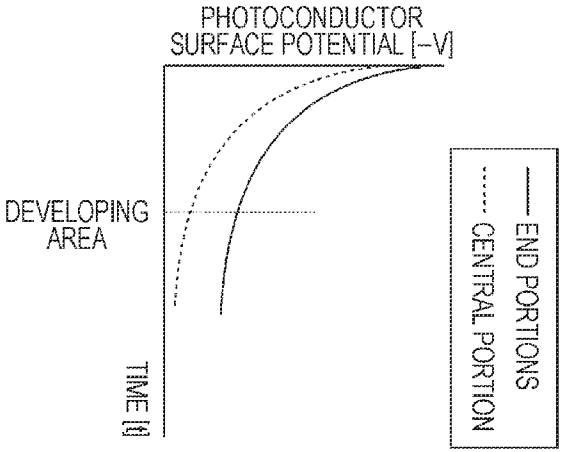
Figure 8D:
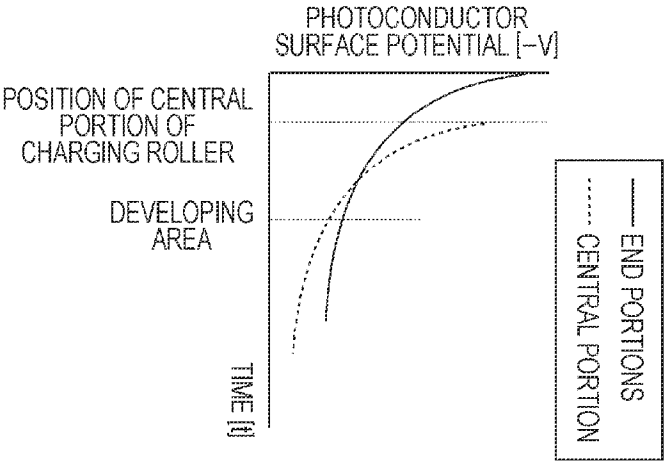

FIGS. 8A to 8D are graphs in which the horizontal axis shows the position in the circumferential direction on the surface of a photoconductor and the vertical axis shows the potential on the surface of the photoconductor. FIG. 8A shows the initial state in which the photoconductor is not worn in the case where the charging roller CR of the first exemplary embodiment or a charging roller of the related art that includes a shaft is used. FIG. 8B shows the state in which the photoconductor has become worn over time in the case where the charging roller of the related art that includes the shaft is used. FIG. 8C shows the initial state in the case where a shaftless charging roller of the related art is used. FIG. 8D illustrates the state in which the photoconductor has become worn over time in the case where the charging roller CR of the first exemplary embodiment or the shaftless charging roller of the related art is used.

Referring to FIGS. 7A and 7B, a charging roller 02 according to the related art includes a shaft 01 as an example of a rotation rod that extends through the charging roller 02. In the case where the charging roller 02 is pressed against a photoconductor 06 so that the charging roller 02 is rotated by the rotation of the photoconductor 06, the charging roller 02 is generally pressed against the photoconductor 06 by springs 07 at both ends of the charging roller 02 in the axial direction. In the structure including the shaft 01 illustrated in FIG. 7A, even when the shaft 01 has a high rigidity, the shaft 01 is bent at a central area thereof. Therefore, the contact pressure applied to the charging roller 02 in the central area thereof is lower than that at the ends thereof in the axial direction. Therefore, end portions of the photoconductor 06, which is in contact with the charging roller 02, are more easily worn than a central portion of the photoconductor 06.

In general, when a constant direct-current voltage is applied to the charging roller 02, in particular, when only a direct-current voltage is applied, the amount of electricity discharged by the photoconductor 06 increases and the charging potential increases accordingly as the layer thickness decreases. Therefore, the charging potential of the end portions of the photoconductor 06, which are easily worn, more easily increases over time than that of the central portion of the photoconductor 06. Once the end portions of the photoconductor 06 are worn, the amount of electricity discharged by the end portions increases. Therefore, owing to the stress caused by the electric discharge, the end portions of the photoconductor 06 are further easily worn and the charging potential of the end portions of the photoconductor 06 further increases.

Referring to FIG. 8A, in the initial state in which the photoconductor 06 is not worn, the charging potential of the end portions of the photoconductor 06 in the axial direction shown by the solid line is substantially equal to the charging potential of the central portion of the photoconductor 06 in the axial direction shown by the dashed line in FIG. 8A. Although dark decay occurs in which the charging potential decreases until the charged surface reaches the development area, the dark decay simultaneously occurs at the central and end portions. Accordingly, the charging potentials of the central and end portions in the development area are substantially equal to each other.

In contrast, as illustrated in FIG. 8B, when the amount of wear of the end portions becomes larger than that of the central portion over time, the charging potential of the end portions increases, which leads to non-uniform charging, that is, a charging failure. In the photoconductor 06 that causes a charging failure, a potential difference is generated between the charging potentials of the central and end portions of the photoconductor 06 in the development area. This leads to a developing failure or degradation of image quality.

Of the charging rollers according to the related art illustrated in FIG. 7A to 7D, the charging roller 02 illustrated in FIGS. 7A and 7B includes the shaft 01, and a shaftless charging roller 04 illustrated in FIGS. 7C and 7D includes rotation rods 03 that do not extend through the charging roller 04. In the shaftless charging roller 04, the total length of the rotation rods is small. As a result, the manufacturing cost may be reduced.

In the shaftless charging roller 04 illustrated in FIG. 7C, no shaft extends through the central portion of the charging roller 04 as in the charging roller 02 including the shaft 01. Therefore, the pressing force of the springs 07 is not effectively applied to the central portion of the charging roller 04 in the axial direction, but tends to concentrate at the end portions of the charging roller 04 in the axial direction. Therefore, compared to the case in which the charging roller 02 including the shaft 01 is used, when the shaftless charging roller 04 is used, the end portions of the charging roller 04 is more easily worn and the life of the photoconductor PR tends to decrease.

In addition, since no shaft is provided at the central portion of the shaftless charging roller 04 in the axial direction, compared to the charging roller 02 including the shaft 01, the central portion of the charging roller 04 in the axial direction thereof is more easily bent toward the downstream side as the photoconductor 06 rotates, as illustrated in FIG. 7D. As a result, the end portions of the photoconductor 06 in the axial direction are charged at an upstream position and the central portion of the photoconductor 06 in the axial direction is charged at a downstream position. Accordingly, as illustrated in FIG. 8C, in the initial state in which the amount of wear of the photoconductor 06 is small, the position at which the photoconductor 06 is charged differs between the end portions shown by the solid line and the central portion shown by the dashed line. The reduction in the charging potential caused by the dark decay at the central portion, which is closer to the developing position than the end portions are, is smaller than that at the end portions. As a result, the charging potential differs between the end portions and the central portions.

When the amount of wear of the photoconductor 06 increases over time, as illustrated in FIG. 8D, the charging potential of the end portions of the photoconductor 06 increases. Therefore, the difference in charging potential in the development area decreases.

The charging roller CR according to the first exemplary embodiment is a shaftless charging roller, and the manufacturing cost is reduced compared to the case in which a charging roller including a shaft is used. In addition, the charging roller CR is pulled by the tension springs 13 in the axial direction, and is not easily bent as illustrated in FIG. 7D. Thus, according to the first exemplary embodiment, the shaftless charging roller CR may be used, and the difference in charging potential at the developing position may be reduced even when the amount of wear of the photoconductor PR is small, as illustrated in FIG. 8A.

In the structure of the first exemplary embodiment in which the charging roller CR is pulled in the axial direction, unlike the shaftless charging roller 04 according to the related art illustrated in FIG. 7C, the charging roller CR is not easily bent and the pressing force which presses the charging roller CR against the photoconductor PR is effectively applied at the central portion of the charging roller CR in the axial direction. Accordingly, compared to the structure of the related art illustrated in FIG. 7C, the end portions of the photoconductor PR are less easily worn and the life of the photoconductor PR may be increased. As a result, the replacement cost may be reduced.

In addition, in the charging device CR+11 according to the first exemplary embodiment, the pulling motor 17 is operated every time the adjustment determination number Na of sheets is reached, so that the pulling frames 12 are moved toward each other and the tension of the tension springs 13 applied to the charging roller CR is reduced over time. Accordingly, the state of the charging roller CR is changed over time to the state in which the central portion of the charging roller CR is easily bent toward the downstream side, as illustrated in FIG. 7D, and the amount of bending of the charging roller CR gradually increases. Therefore, as the amount of wear of the end portions increases over time and the charging potential of the end portions increases accordingly, the central portion of the charging roller CR in the axial direction is bent toward the downstream side, so that the charging position of the central portion of the photoconductor PR is shifted downstream. Accordingly, the state of the photoconductor PR becomes closer to the state illustrated in FIG. 8D, so that the difference in charging potential between the central and end portions of the photoconductor PR in the axial direction in the developing area Q2 decreases. As a result, the occurrence of degradation of image quality due to non-uniform charging may be reduced.

Second Exemplary Embodiment

Figure 9:
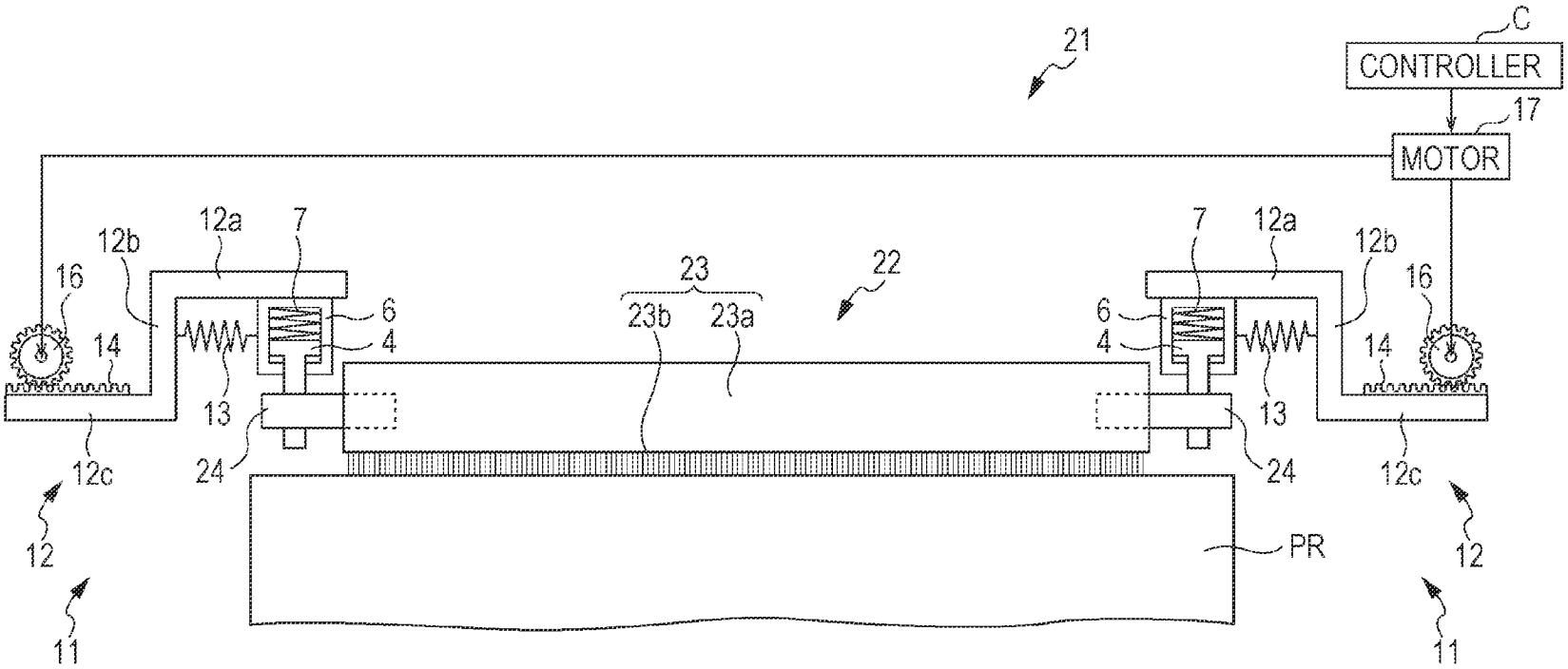
FIG. 9 is a diagram corresponding to FIG. 4 that shows the first exemplary embodiment, and illustrates a charging device according to a second exemplary embodiment of the present invention.

FIG. 9 is a diagram corresponding to FIG. 4 that shows the first exemplary embodiment, and illustrates a charging device according to a second exemplary embodiment of the present invention.

The charging device according to the second exemplary embodiment of the present invention will now be described. In the description of the second exemplary embodiment, components corresponding to those of the first exemplary embodiment are denoted by the same reference numerals, and detailed explanations thereof are thus omitted. The structure of the second exemplary embodiment is similar to that of the first exemplary embodiment except for the following points.

That is, referring to FIG. 9, a charging device 21 according to the second exemplary embodiment includes a charging brush 22, which is an example of a charging member, in place of the charging roller CR that rotates according to the first exemplary embodiment. The charging brush 22 extends in the axial direction of the photoconductor PR. The charging brush 22 according to the second exemplary embodiment includes a charging brush body 23, which is an example of a charging member body, and axial-end pins 24, which are examples of axial-end members. The axial-end pins 24 are supported at both ends of the charging brush body 23 in the axial direction. The charging brush body 23 includes a base cloth 23*a* that extends in the axial direction and a conductive brush portion 23*b* that is supported by the base cloth 23*a* at a proximal end thereof and that is in contact with the surface of the photoconductor PR to charge the surface of the photoconductor PR at a distal end thereof. Similar to the first exemplary embodiment, the base cloth 23*a* is supported at both ends thereof in the axial direction by axial-end pins 24 that do not extend through the base cloth 23*a* in the axial direction. The axial-end pins 24 are fixed to the sliders 4. The bearings 3 according to the first exemplary embodiment are omitted in the second exemplary embodiment.

Operation of Second Exemplary Embodiment

Similar to the first exemplary embodiment, with the charging device 21 according to the second exemplary embodiment having the above-described structure, the shaftless charging brush 22 that does not have a shaft that extends therethrough may be used to reduce the costs. In addition, the potential difference in the development area Q2 may be reduced even when the amount of wear of the photoconductor PR increases from the state in which the amount of wear is small.

Modifications

Although exemplary embodiments of the present invention are described in detail above, the present invention is not limited to the above-described exemplary embodiments, and various modifications are possible within the scope of the present invention defined by the claims. Modifications (H01) to (H06) of the present invention will now be described.

(H01) Although the printer U is described as an example of the image forming apparatus in the above-described exemplary embodiments, the image forming apparatus is not limited to this, and may instead be, for example, a copy machine, a facsimile machine, or a multifunction machine having the functions of these machines. The image forming apparatus is also not limited to a monochrome image forming apparatus, and may instead be a color image forming apparatus.

(H02) In the above-described exemplary embodiments, the roller-shaped charging roller CR and the brush-shaped charging brush 22 are described as the charging members. However, the charging member is not limited to this, and may instead be any type of known contact charging member, such as a rotating charging brush.

(H03) The structure for pulling the charging member CR, 22 is not limited to those described in the exemplary embodiments as long as the charging member CR, 22 may be pulled in the axial direction. For example, although the tension springs 13 may be provided to compensate for elastic deformation of the charging member CR, 22, thermal expansion of the charging member CR, 22, and expansion and contraction of the charging member CR, 22 caused by an external force or the like, the tension springs 13 may be omitted. In such a case, the charging member CR, 22 may be pulled in the axial direction by, for example, a string-shaped member, a rod-shaped member, or a lever. When the tension is adjusted, the string, the rod, the lever, etc., are operated to control the tension.

(H04) In the above-described exemplary embodiments, the tension may be reduced over time. However, if the photoconductor PR is wear resistant and the potential difference between the central and end portions does not easily increase over time, it may simply be desired to deal with the non-uniform charging caused by bending of the shaftless charging roller CR illustrated in FIG. 8C. In such a case, the structure for reducing the tension over time may be omitted.

(H05) The numerical values explained in the above-described exemplary embodiments may be changed as appropriate in accordance with, for example, the design and specifications.

(H06) Although the pulling devices 11 are provided at both ends in the axial direction in the above-described exemplary embodiments, only one pulling device 11 may be provided at one end in the axial direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging member that charges a surface of an image carrier, the charging member including a charging member body that is arranged so as to face the image carrier and that extends along an axial direction of a rotation shaft of the image carrier, and axial-end members that are supported at both ends of the charging member body in the axial direction and that do not extend through the inside of the charging member body in the axial direction; and a pulling device that pulls the charging member in the axial direction.

2. The charging device according to claim 1, further comprising:

a counting unit that counts the accumulated number of revolutions of the charging member; and a tension control unit that reduces a tension applied by the pulling device over time on the basis of the accumulated number of revolutions counted by the counting unit.

3. An image forming apparatus comprising:

an image carrier;

the charging device according to claim 1, the charging device charging a surface of the image carrier;

a latent-image forming device that forms a latent image on the charged surface of the image carrier;

a developing device that develops the latent image on the surface of the image carrier into a visual image;

a transfer device that transfers the visual image on the surface of the image carrier onto a medium; and a fixing device that fixes the visual image on the surface of the medium.

4. An image forming apparatus comprising:

an image carrier;

the charging device according to claim 2, the charging device charging a surface of the image carrier;

a latent-image forming device that forms a latent image on the charged surface of the image carrier;

a developing device that develops the latent image on the surface of the image carrier into a visual image;

a transfer device that transfers the visual image on the surface of the image carrier onto a medium; and a fixing device that fixes the visual image on the surface of the medium.

* * * * *